US005628381A

United States Patent [19]

Markovich et al.

[11] Patent Number: 5,628,381

[45] Date of Patent: May 13, 1997

[54] LADDER SAFETY APPARATUS AND METHOD

[75] Inventors: David H. Markovich, 4979 Simcoe Cir., Marietta, Ga. 30062; William M. Foster, Sandy Springs, Ga.

[73] Assignee: David H. Markovich, Marietta, Ga.

[21] Appl. No.: 587,370

[22] Filed: Jan. 16, 1996

Related U.S. Application Data

[63] Continuation-in-part of Ser. No. 508,264, Jul. 27, 1995, abandoned.

[51] Int. Cl.[6] ..... E04G 5/02

[52] U.S. Cl. ..... 182/107; 182/129; 248/210

[58] Field of Search ..... 182/107, 206, 182/129, 214, 108; 248/210

[56] References Cited

U.S. PATENT DOCUMENTS

| | | | |
|---|---|---|---|
| D. 356,166 | 3/1995 | Spiller | D25/68 |
| 974,681 | 11/1910 | Manquais | 248/300 |
| 1,450,694 | 4/1923 | Mahoney | 182/107 |
| 1,658,753 | 2/1928 | Wirth | 182/120 |
| 2,103,603 | 12/1937 | Voigt | 182/120 |
| 2,935,285 | 5/1960 | Drom | 248/300 X |
| 3,853,202 | 12/1974 | Jarboe | 182/206 |
| 4,085,818 | 4/1978 | Swager | D25/68 |
| 4,184,568 | 1/1980 | Hillier | 182/8 |
| 4,444,291 | 4/1984 | McPherson | 182/214 |
| 4,643,275 | 2/1987 | LeBlanc | 182/107 |
| 4,770,272 | 9/1988 | Riley | 248/210 |
| 4,836,331 | 6/1989 | Foradori | 182/107 |
| 5,149,039 | 9/1992 | Peterson et al. | 248/300 |
| 5,383,533 | 1/1995 | Nikula et al. | 182/107 |

FOREIGN PATENT DOCUMENTS 16929 7/1927 Netherlands .

*Primary Examiner*—Alvin C. Chin-Shue

*Attorney, Agent, or Firm*—Thomas, Kayden, Horstemeyer & Risley

[57] ABSTRACT

A ladder safety apparatus (10, 60, 70, 80) stabilizes a ladder (36) residing against a structure (38) by effectively securing the upper end of the ladder (36) to the structure (38). The safety apparatus (10, 60, 70, 80) includes at least first and second side members (12, 13) that are interconnected at a transverse angle, preferably ninety degrees. An opening (22) is located in the second side member (13) for receiving and passing one of the ladder rails (**39*a*, 39*b*) therethrough. The opening (22) has a first part (24) for passing the rail (39*a*, 39*b*) and a second part (26) that interconnects the first part (24) to a boundary edge (28) of the second side member (13). The second part (26) enables installation of the apparatus (10, 60, 70, 80). Optionally, one or more apertures (16) may be disposed in the first wall (12) for receiving and passing a gutter ferrule (52) or other pin-like member therethrough for further stabilization of the ladder (36). Moreover, optionally, an attachment mechanism (82) may be implemented for associating the apparatus (10, 60, 70, 80) with the ladder (36), so that it becomes an integral part thereof, when the apparatus (10, 60, 70, 80) is not being used to secure the ladder (36) to the structure (38**) .

10 Claims, 5 Drawing Sheets

LADDER SAFETY APPARATUS AND METHOD

This document is a continuation-in-part of the application entitled "LADDER SAFETY APPARATUS AND METHOD," filed Jul. 27, 1995, by David H. Markovich et al., that was assigned Ser. No. 08/508,264 abandoned.

FIELD OF THE INVENTION

The present invention generally relates to safety devices for ladder users and accessories for ladders, and more particularly, to ladder safety apparatuses and methods for effectively securing the upper end of a ladder while the ladder resides against a structure. The ladder safety apparatuses and methods can utilize a novel ladder attachment mechanism, as disclosed and claimed herein, for securing a ladder safety apparatus to a ladder when the apparatus is not in use so that the ladder safety apparatus, in effect, becomes an integral part of the ladder.

BACKGROUND OF THE INVENTION

A ladder is often used to reach high locations on a structure, such as a building, residential house, or office complex. The ladder typically has parallel longitudinal rails with rungs disposed therebetween along the longitudinal length of the rails.

For the safe use of a ladder, the ladder should be properly stabilized against the structure. A user typically ensures that the base of the ladder is positioned upon a stable surface or ground area, while the elongated dual rails of the ladder are positioned substantially vertically and leaning against the structure by an appropriate inclination angle. However, use of a ladder is still generally hazardous in that the ladder can oftentimes be moved, destabilized, and caused to fall away from proper engagement with the structure while the ladder is in use.

U.S. Pat. No. 4,444,291 to McPherson describes a ladder accessory for securing the upper end of a ladder to a structure to stabilize the ladder against the structure. Although not totally devoid of merit, this apparatus is an undesirably complex structure, requiring a sophisticated attachment mechanism that attaches to both rails of the ladder. Furthermore, the apparatus is expensive to produce and takes an inordinate amount of time to install.

SUMMARY OF THE INVENTION

An object of the present invention is to overcome the deficiencies and inadequacies of the prior art as indicated above.

Another object of the present invention is to provide a ladder safety apparatus and method for effectively and reliably stabilizing a ladder while disposed against a structure.

Another object of the present invention is to provide a ladder safety apparatus and method that securely anchors a ladder to a structure, yet allows for easy and frequent disengagement for permitting easy and frequent movement of the ladder.

Another object of the present invention is to provide a ladder safety apparatus that is inexpensive to produce and implement.

Another object of the present invention is to provide a ladder safety apparatus that is reliable for continued repetitive use.

Briefly described, the present invention provides for a ladder safety apparatus and method for effectively stabilizing a ladder disposed against a structure by securing the upper end of the ladder to the structure. The novel safety apparatus has a ladder engagement side member with an opening of sufficient size to receive a ladder rail therethrough, and a structure engagement side member connected to and extending at a transverse angle from the ladder engagement side member. The ladder is secured with the safety apparatus to the structure by passing one of the rails through the opening and disposing the structure engagement side member against the structure.

In the preferred embodiment, the ladder engagement side member and the structure engagement side member are both generally planar and are disposed at approximately a 90° angle to each other. Moreover, the opening is T-shaped and comprises a stem part and a cross part. The cross part is substantially rectangular and located internally to a boundary of the ladder engagement side member. The stem part extends from the cross part to a boundary edge of the ladder engagement side member. One of the rails of the ladder is passed through the cross part of the T-shaped opening.

In order to make the safety apparatus symmetrical and applicable to either of the two longitudinal rails of the ladder, another structure engagement side member is connected to the ladder engagement side member so that the two structure engagement side members are substantially parallel and the apparatus exhibits a C-shaped cross-section.

Another preferred feature of the safety apparatus is the disposition of one or more apertures in the structure engagement side member(s). The aperture(s) is preferably an elongated channel that extends from a boundary edge of the structure engagement side member(s) inwardly and is of sufficient size to pass therethrough a gutter ferrule or an elongated member passing transverse to a longitudinal axis associated with the gutter. With the safety apparatus secured to the gutter ferrule, the ladder is optimally secured to the structure.

In accordance with another feature of the invention, the ladder safety apparatus may be equipped with an attachment mechanism for securing the ladder safety apparatus to the ladder when the apparatus is not being used. In essence, the ladder safety apparatus becomes an integral part of the ladder, when the attachment mechanism is utilized. In the preferred embodiment, the attachment mechanism includes a flexible cord that is attached at its ends to the ladder safety apparatus, to thereby form a loop. Moreover, the looped end is wrapped under tension around a rung of the ladder, and the loop is disposed to run through at least one aperture in a structure engagement side member, but preferably through two opposing apertures in opposing structure engagement side members.

The novel safety method of the present invention can be broadly summarized as follows: positioning a ladder against a structure and securing one or both of the two vertical ladder rails to the structure. Preferably, one of the vertical ladder rails is secured to a gutter ferrule associated with the structure.

In addition to achieving all of the aforementioned objects, the safety apparatus and method of the present invention have numerous advantages, a few of which are delineated hereafter, as examples.

An advantage of the safety apparatus is that it is simple and durable structure.

Another advantage of the safety apparatus is that it is inexpensive to manufacture on a mass scale.

Another advantage of the safety apparatus is that it can be easily and quickly installed and removed with a single hand of the user for permitting easy and quick movement of a ladder.

Another advantage of the safety apparatus is that it can be constructed to be symmetrical (about a plane) so that it can be utilized with either of the ladder rails.

Another advantage of the safety apparatus is that it can be more permanently installed by driving a nail or screw through the apparatus into the structure. This configuration may be desirable for construction sites where a gutter has not yet been installed or in connection with a parapet roof, which does not have a gutter and which is often utilized on large office complexes.

Another advantage of the safety apparatus is that it can be provided with a plurality of apertures for receiving the gutter ferrule so that, even if the ladder shifts while a user transcends up the ladder rungs prior to installation of the apparatus, one of the apertures will still be aligned with the gutter ferrule.

Another advantage of the safety apparatus is that an attachment mechanism can be employed for securing the ladder safety apparatus to a ladder when the apparatus is not in use so that the ladder safety apparatus, in effect, becomes an integral part of the ladder and is transported therewith.

Other objects, features, and advantages of the present invention will become apparent to one with skill in the art upon examination of the following drawings and detailed description. It is intended that all such additional objects, features, and advantages be included herein within the scope of the present invention, as defined in the appended claims.

BRIEF DESCRIPTION OF THE DRAWINGS

The present invention can be better understood with reference to the following drawings. The drawings are not necessarily to scale, emphasis instead being placed upon clearly illustrating principles of the present invention. Furthermore, like reference numerals designate corresponding parts throughout the several views.

DETAILED DESCRIPTION OF THE PREFERRED EMBODIMENTS

Figure 1:
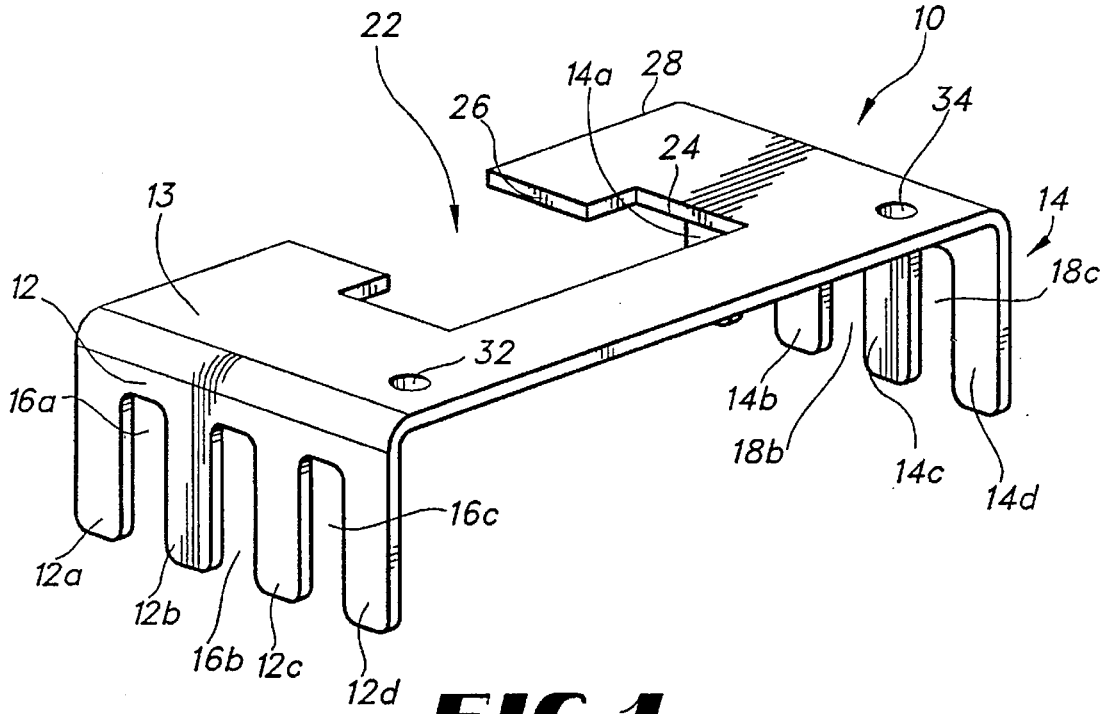
FIG. 1 is a top perspective view of a first embodiment (best mode) of the safety apparatus of the present invention.
Figure 2:
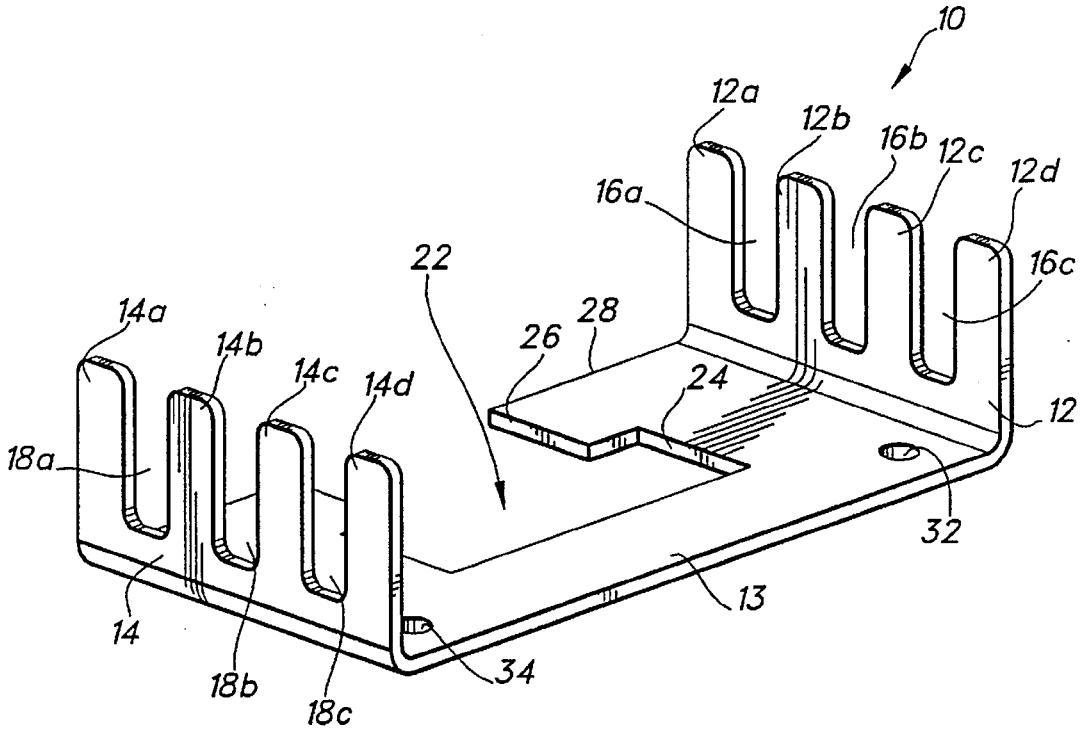
FIG. 2 is a bottom perspective view of the first embodiment FIG. 1.

A first embodiment of the safety apparatus of the present invention is illustrated in FIGS. 1 and 2 and is generally denoted by reference numeral 10. The first embodiment represents the best mode, known at present, for practicing the present invention.

In structure, the safety apparatus 10 has a first side member 12, a second side member 13 connected to the first side member 12 at a transverse angle (preferably about 90°), and a third side member 14 connected to the second side member 13 at a transverse angle (preferably 90°). The first, second, and third side members 12, 13, 14 form a body having a cross-sectional C-shaped configuration, as shown in FIGS. 1 and 2.

Optionally, but preferably in this embodiment, the first and third side members 12, 14 have a plurality of rectangular tines (also, fingers or claws) 12*a*–12*d*, 14*a*–14*d*, respectively, that are separated by apertures 16*a*–16*c*, 18*a*–18*c*, respectively. The apertures 16*a*–16*c* and 18*a*–18*c* are preferably equally spaced along the respective side members 12, 14, and extend from the bottom edges of the respective side members 12, 14 inwardly a substantial distance along the span of the side members 12, 14. It should be noted that the first and third side members 12, 14 can be constructed to have no apertures 16, 18 or any number of apertures 16, 18.

The second side member 13 has an opening 22 that is preferably T-shaped, but many other suitable configurations are possible, including for example but not limited to, an L-shaped configuration (for instance, see FIG. 6) or rectangular configuration. The T-shaped opening 22 has a substantially rectangular first part 24 situated substantially centrally within the second side member 13 and a second part 26 that connects to the first part 24 and extends outwardly to a boundary edge 28 of the second side member 13. The first part 24 is of a size to permit passage of a vertical longitudinal ladder rail (39*a*, 39*b* of FIG. 3) and binding of inner edges of the first part 24 against the rail, as will be further described. Moreover, the second part 26 is sufficiently large enough to permit insertion of the ladder rail therethrough and/or passage of ladder rungs so that the safety apparatus 10 can be installed, as will be further described and clarified hereinafter. In the preferred embodiments, the first part 24 has a short side (sometimes called flange side) measuring between about 1 and 1 7/16 inches, and the second part 26 has a long side (sometimes called rail side) measuring between about 3 1/8 and 3 13/16 inches. These measurements accommodate ladder rails having a short side between about 3/4 and 1 3/8 inches and a long side between about 2 1/2 and 3 1/2 inches.

Optionally, but preferably in this embodiment, the second side member 13 further includes holes 32, 34, preferably cylindrical, that are of sufficient size to pass a nail, screw, pin, or other elongated member. The holes 32, 34 are situated in the second side member 13 and in close proximity to the respective side members 12, 14.

Figure 3:
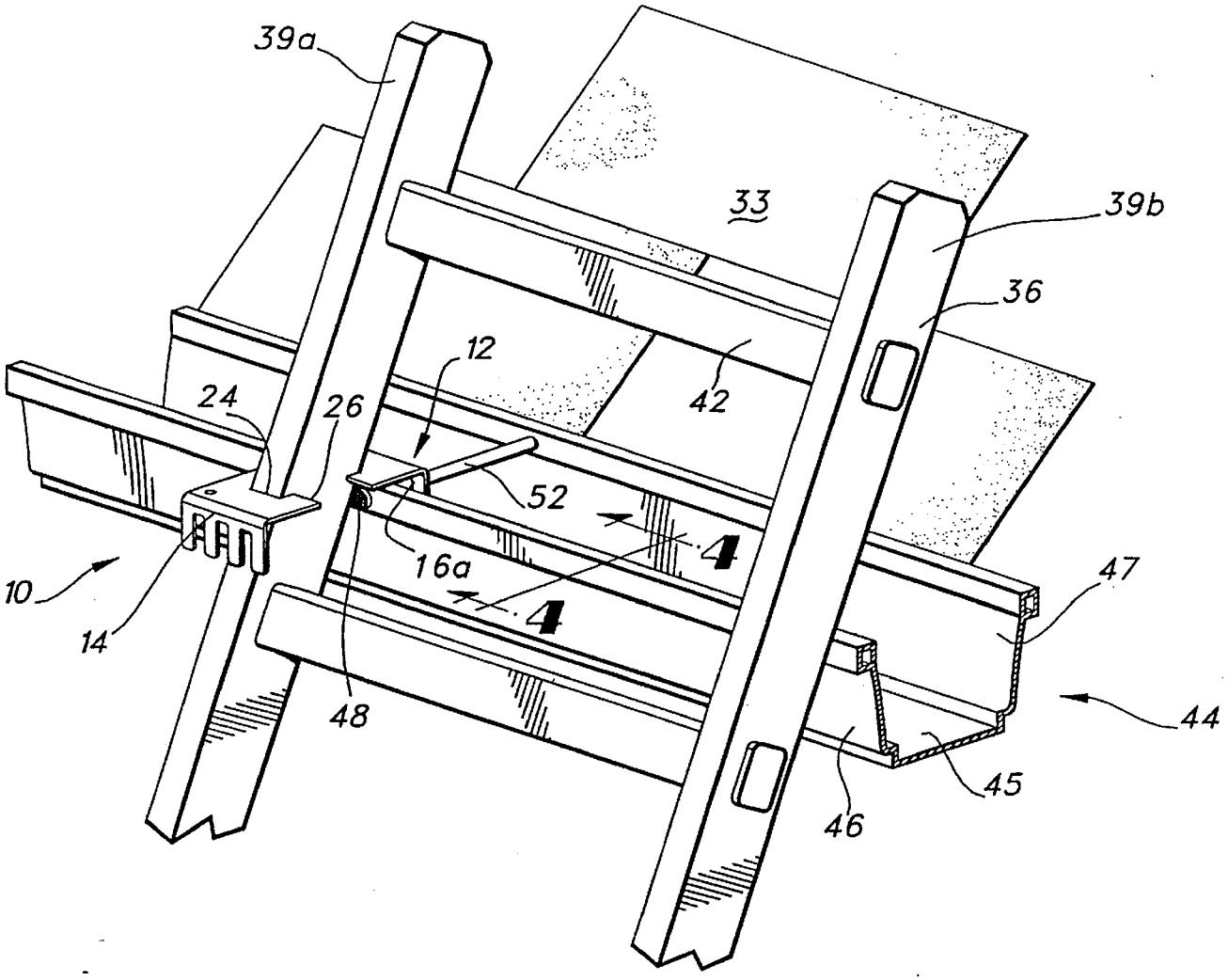
FIG. 3 is a perspective view of the first embodiment of FIG. 1 installed to secure a ladder to a structure.

The safety apparatus 10 can be installed and utilized, as shown in FIG. 3, to secure a ladder 36 to a structure 38. The ladder 36 comprises dual vertical elongated rails 39*a*, 39*b* with horizontal rungs 42 interposed therebetween. Furthermore, the structure 38 can be anything to which the ladder 36 can be leaned against. The structure 38 has a gutter 44 in the preferred arrangement, but the gutter 44 is not necessary to utilize the safety apparatus 10 of the present invention.

Figure 4:
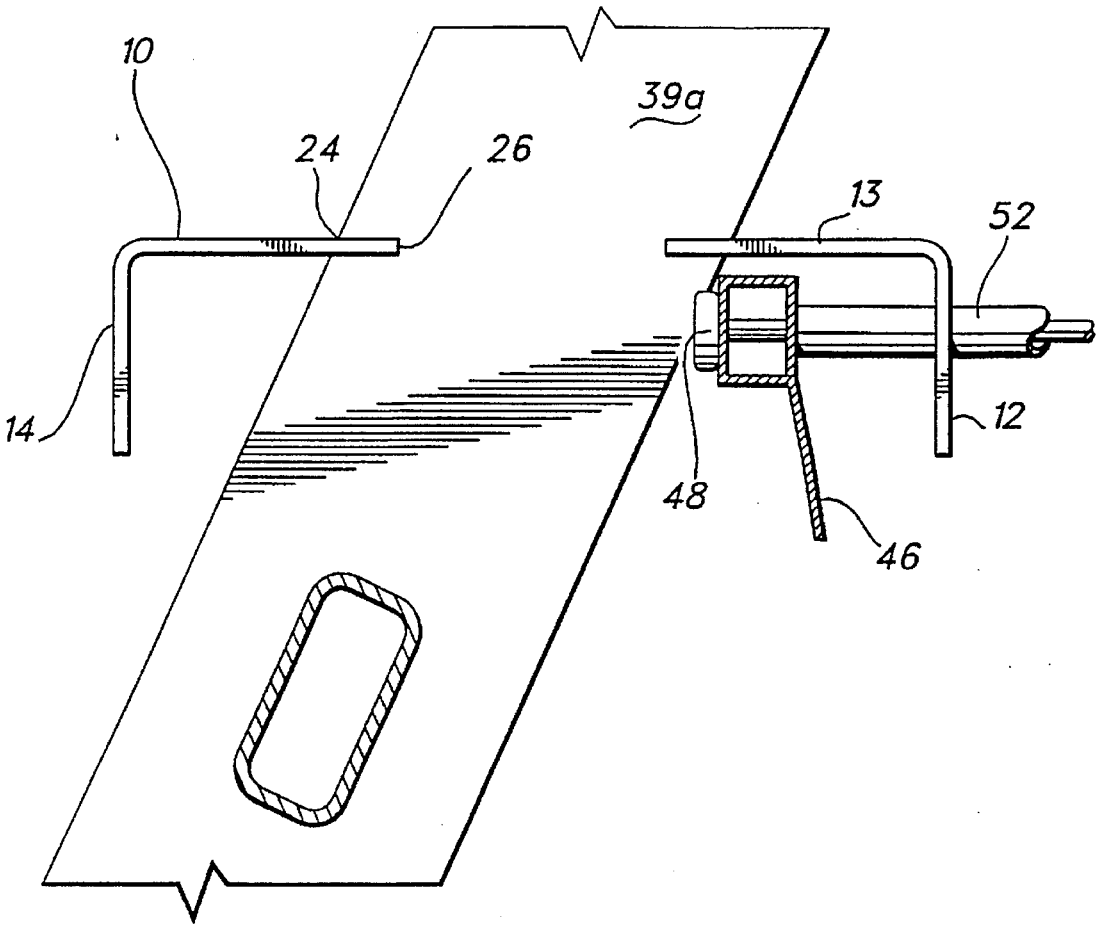
FIG. 4 is a side view of the first embodiment as taken along line 4—4 in FIG. 3.

Typically, the gutter 44 has a U-shaped cross-section with a bottom side member 45 connected to upstanding side walls 46, 47. Furthermore, as shown in FIG. 4, the gutter 44 is secured to the structure 38 usually by a series of nails 48 or other like elements that are usually spaced about 4 feet apart and that pass through the top end of the gutter side walls 46, 47 and into the structure 38. So that the nails 48 do not crush the gutter 44 during installation of the gutter 44, a generally smooth cylindrical bushing-like ferrule 52 is typically placed between the top end of the side walls 46, 47 and surrounds the nail 48.

The safety apparatus 10 is installed in the configuration shown in FIG. 3 as follows. Note that the safety apparatus 10 can be installed on either rail 39*a*, 39*b*, but for purposes of simplicity, the installation will be described relative to the rail 39*a*, and the discussion is equally applicable and analogous to installation on the rail 39*b*. First, the ladder 36 is leaned against the structure 38. When the structure 38 has a gutter 44, the ladder 36 is leaned against the gutter 44, as is illustrated in FIG. 3. As the ladder is leaned against the gutter 44, an attempt is made to lean the ladder rail 39*a* against a gutter nail 48. This configuration will insure that at least one of the apertures 16*a*–16*c* will be capable of capturing the gutter ferrule 52 or other pin-like element.

As an example, FIG. 3 shows the ladder 36 leaning against the gutter 44 at a position adjacent to, but not directly over, a nail 48. This predicament could result from a slight misalignment when the ladder 36 is leaned against the gutter 44, or possibly, a shift in the ladder 36 when a user moves up the ladder 36.

Next, the safety apparatus 10 is positioned so that the rails 39*a* passes through the opening 22, and particularly the first part 24, while one of the apertures 16*a*–16*c* (e., aperture 16*a* as shown in FIG. 3) is positioned to receive and pass the ferrule 52 or other pin-like element therethrough. The apparatus 10 can be disposed in the foregoing configuration by inserting the top end of the rail 39*a* directly into the first part 24 and sliding the apparatus 10 downwardly along the rail 39*a* past the rung(s) 42, the rung(s) 42 passing through the second part 26. In some circumstances, the width of the second part 26 is sufficiently large to permit insertion of the short side (sometimes called the flange side) of the rail 39*a* directly through the second part 26 and then the safety apparatus 10 can be turned by approximately 90° so that the rail 39*a* passes through the first part 24 and can be slid down the rail 39*a* into the desired position, as shown in FIG. 3. As the safety apparatus 10 is slide down into the desired resting position, the bottom edges of the first side member 12 (or bottom edges of the tines 12*a*–12*d* engage the structure 38, thereby causing the apparatus 10 to angle backwardly and causing the front and back inner edges of the opening first part 24 in the second side member 13 to engage and bind against the lateral surfaces of the ladder rail 39*a*.

For best results, the bottom edge of the third side member 14 (or bottom edges of the tines 14*a*–14*d*) should not engage the lateral surface of the ladder rail 39*a*. In fact, in the preferred embodiment, the dimensions of the first part 24 of the opening 22 are such that this predicament cannot be achieved.

When the structure 38 does not have the gutter 44, the safety apparatus 10 is positioned so that the rail 39*a* passes through the opening 22, and particularly the first part 24, while the bottom edges of the tines 12*a*–12*d* engage and grip a surface on the structure 38. The safety apparatus is situated in the foregoing configuration, as previously described, by inserting the top end of the rail 39*a* into the first part 24 and sliding the apparatus 10 past the rung(s) 42, or alternatively, inserting the rail 39*a* directly through the second part 26, turning the safety apparatus 10 by approximately 90° so that the rail 39*a* resides within the first part 24, and sliding the apparatus 10 down into position. With this mounting configuration, it may be desirable to utilize a safety apparatus 10 on both of the rails 39*a* , 39*b* in order to establish a higher degree of frictional engagement between the apparatus 10 and the structure 38.

Figure 5:
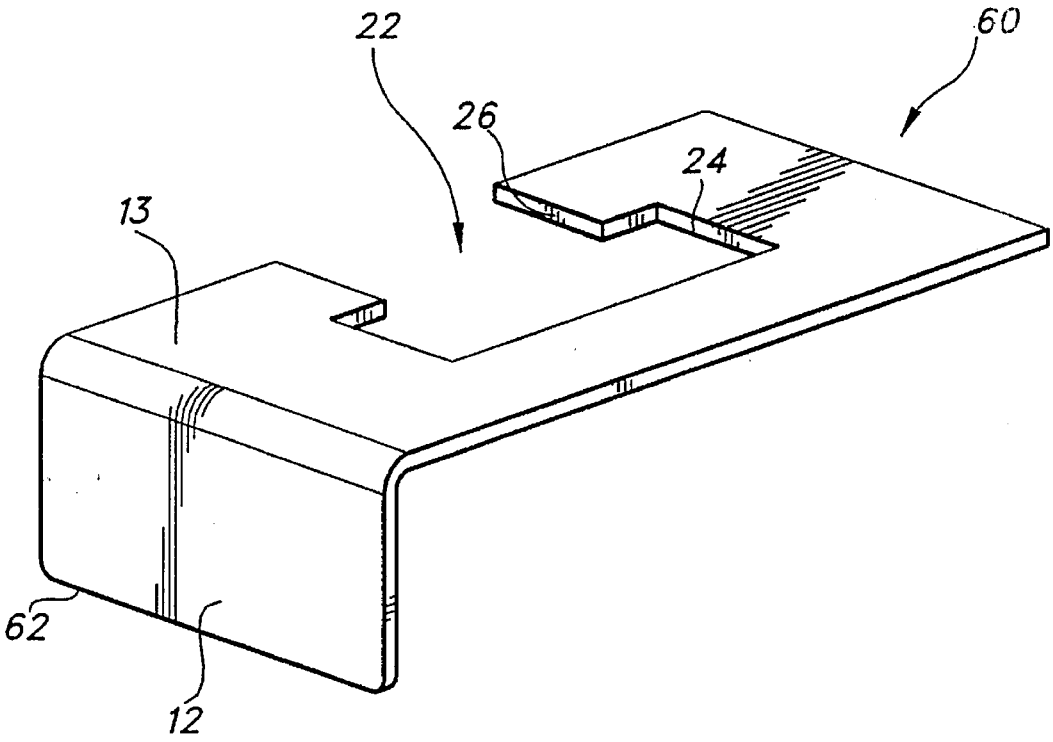
FIG. 5 is a perspective view of a second embodiment of the safety apparatus of the present invention.

A second embodiment of the safety apparatus 10 is illustrated in FIG. 5 and is generally denoted by reference numeral 60. The safety apparatus 60 comprises elements that are similar to the safety apparatus 10 (FIGS. 1 and 2). Accordingly, the discussion previously regarding optional features and regarding elements having like reference numerals is incorporated herein by reference. As shown in FIG. 5, the safety apparatus 60 has only two angled side members 12, 13 and does not include the apertures 16*a*–16*c*, 18*a*–18*c*, but could have, if desired. The safety apparatus 60 is installed similarly as the safety apparatus 10, but is useful for only the ladder rail 39*a* , not the ladder rail 39*b*. Moreover, when the safety apparatus 60 does not include the optional side wall apertures 16*a*–16*c*, 18*a*–18*c*, as is illustrated in FIG. 5, the first wall 12 should be positioned to extend downwardly into the gutter 44 along the wall 46, without obstruction by the ferrule 52. In the case when the structure 38 does not include a gutter 44, the bottom edge 62 is engaged with a surface on the structure 38.

Figure 6:
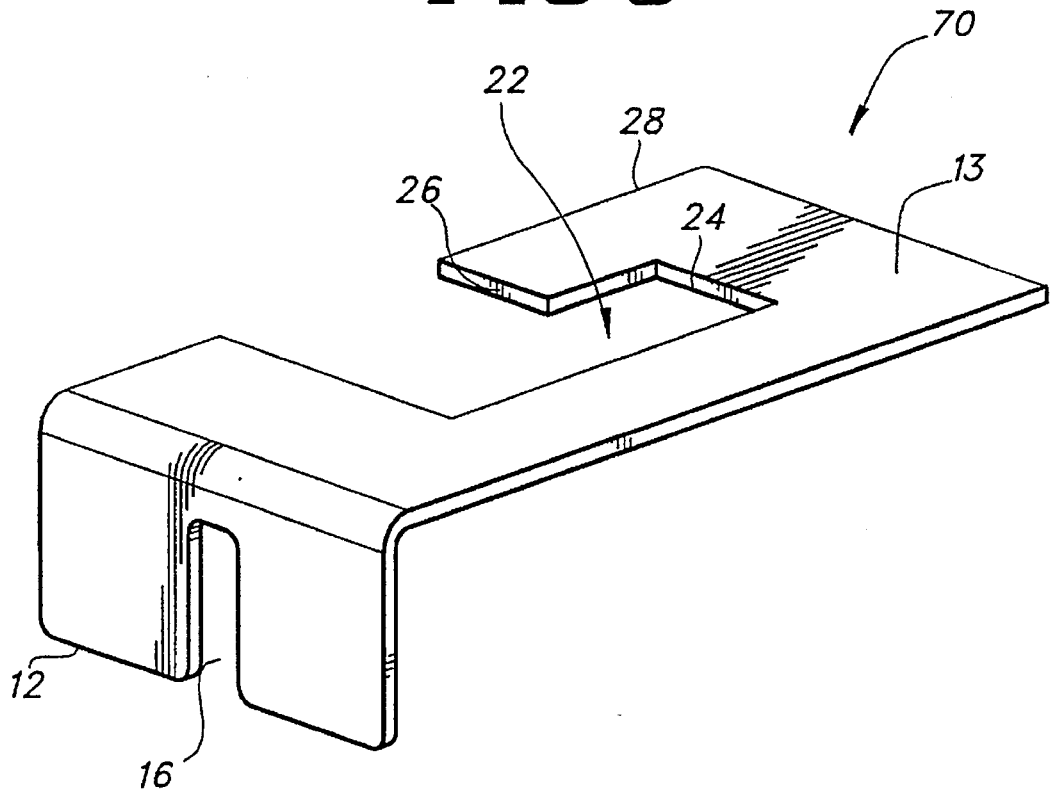
FIG. 6 is a perspective view of a third embodiment of the safety apparatus of the present invention.

A third embodiment of the safety apparatus in accordance with the present invention is shown in FIG. 6 and is generally denoted by reference numeral 70. The safety apparatus 70 has similar elements as the first embodiment (FIGS. 1 and 2), and therefore, the discussion previously regarding optional features and regarding elements having like reference numerals is incorporated herein by reference. The safety apparatus 70 has the first side member 12 interconnected with the second side member 13. Moreover, the second side member 13 has an opening 22 in the shape of an L. The L-shaped opening 22 has a first part 24 situated substantially centrally within the second side member 13 and a second part 26 connecting the first part 24 to the boundary edge 28 of the second side member 13. The first part 24 is sufficiently large to permit passage of a short side of a ladder rail 39*a* , 39*b*, so that the apparatus 70 can be installed by passing one of the rail 39*a* , 39*b* directly through the second part 26, turning the safety apparatus 70 by approximately 90° so that the rail 39*a* , 39*b* resides within the first part 24, and sliding the apparatus 70 down into position. As is apparent, the safety apparatus 70 is useful for only installation with respect to the ladder rail 39*a* , due to its asymmetry and in contrast to the more desirable first embodiment, which can be used on either rails. Finally, the safety apparatus 70 preferably includes a single aperture 16, but more are possible, in the first wall 12 for receiving therethrough the ferrule 52.

Another feature that can be employed with the safety apparatuses 10, 60, 70 is a locking mechanism (not shown) associated with the apertures 16, 18 for locking the gutter ferrule or other pin-like member within the confines of the respective aperture. As an example, the locking mechanism could be configured in the form of a sliding latch bolt that can be passed behind the gutter ferrule or pin-like member after insertion into the aperture.

Figure 8:
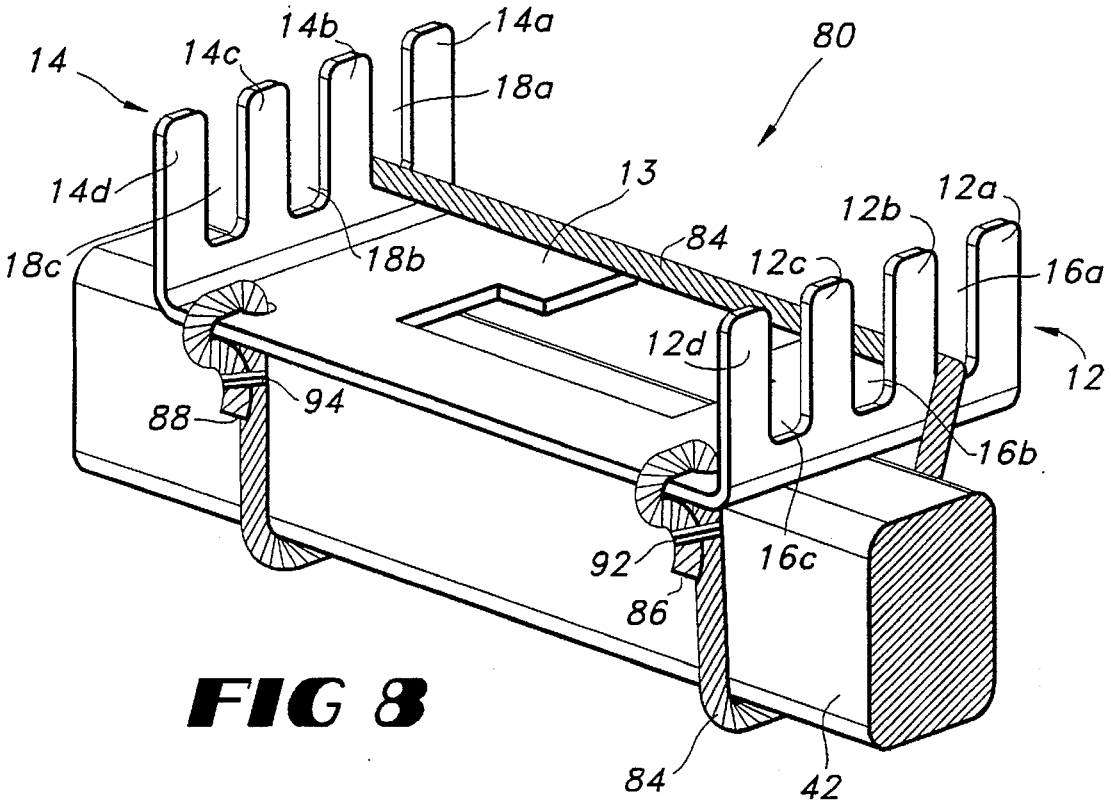
FIG. 8 is a perspective view of the fourth embodiment of FIG. 7 as secured to the ladder.
Figure 7:
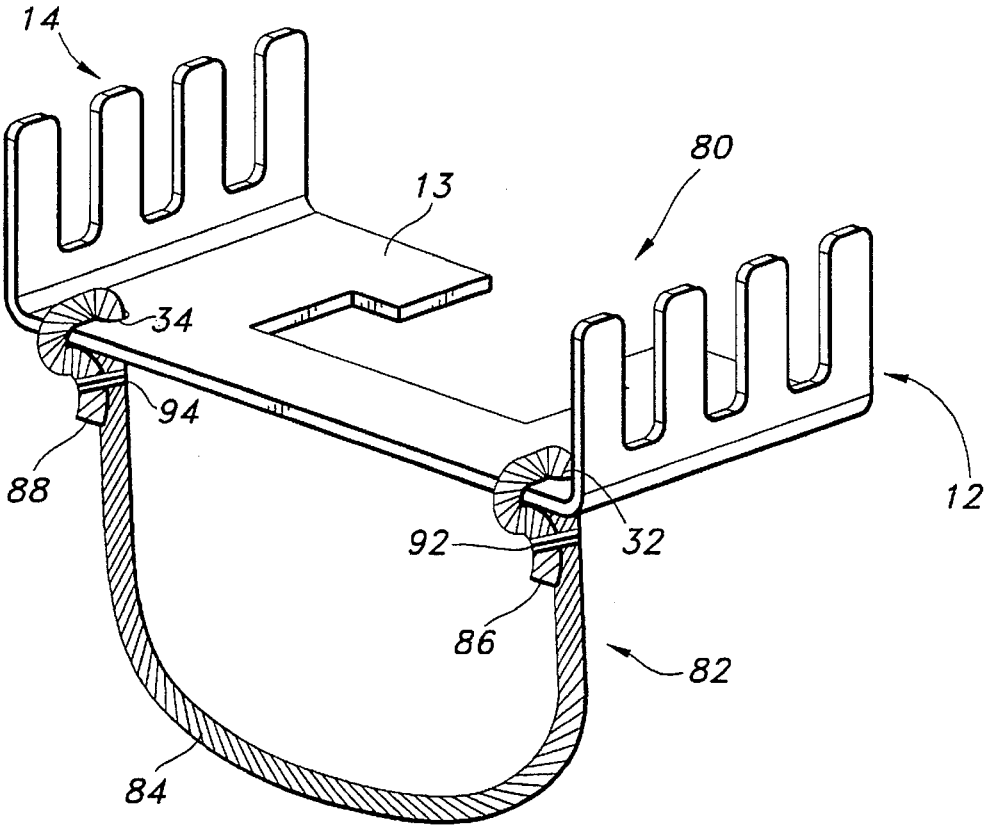
FIG. 7 is a perspective view of a fourth embodiment of the safety apparatus of the present invention.

Yet another feature that can be employed with any of the safety apparatuses described herein is an attachment mechanism for associating the safety apparatus with the ladder 36 (FIG. 3) when the respective safety apparatus is not in use. For purposes of illustration, a fourth embodiment of the safety apparatus of the present invention that employs this feature is illustrated in FIGS. 7 and 8 and is generally denoted by reference numeral 80. In essence, when the attachment mechanism is utilized, the safety apparatus becomes an integral part of the ladder.

FIG. 7 shows the safety apparatus 80, as an example, with an attachment mechanism 82. The safety apparatus 80 comprises elements that are similar to the safety apparatus 10 (FIGS. 1 and 2). Accordingly, the discussion previously regarding optional features and regarding elements having like reference numerals is incorporated herein by reference.

As shown in FIGS. 7 and 8, the attachment mechanism 82 in the preferred embodiment and best mode comprises a flexible cord 84, for example but not limited to, a "BUNGEE"® cord, with its ends 86, 88 secured to the second side member 13 of the safety apparatus 80. The ends 86, 88 are secured to the second side member 13 by passing the ends 86, 88 through respective holes 32, 34 within the second side member 13 and securing the ends 86, 88 back upon their respective cord sections with a suitable affixation mechanism 92, 94, respectively. In the preferred embodiment, the affixation mechanisms 92, 94 are stainless steel wire-like members that are wrapped about the cord sections, as shown.

The safety apparatus 80 is connected or secured to a rung 42 of a ladder 36 (FIG. 3) as shown in FIG. 8. With reference to FIG. 8, the flexible cord 84 is passed under tension around the ladder rung 42 and disposed to pass through one or more apertures 16*a*–16*d*, 18*a*–18*c* within the respective side members 12, 14. Preferably, the flexible cord 84 is disposed to run through the opposing apertures 16*a*, 18*a*, as is shown in FIG. 8. This condition provides very suitable securement of the safety apparatus 80 to the ladder rung 42.

After the ladder 36 (FIG. 3) has been placed against a structure or even beforehand, the safety apparatus 80 is disassociated, or freed, from the rung 42 by removing the flexible cord 84 from the confines of tines 12*a*, 12*b* and 14*a*, 14*b*. Afterward, the apparatus 80 is utilized just as the safety apparatus 10, as was previously described. After usage, the safety apparatus 80 is then again associated with the rung 42, as shown in FIG. 8.

The attachment mechanism may take various other forms. As another example, the attachment mechanism may be embodied by merely a wing nut or other screw passing through the safety apparatus and thence into the ladder, at virtually any location thereon. In order to detach the apparatus, the wing nut or other screw is unscrewed, in whole or in part.

It is obvious to those skilled in the art that many modifications may be made to the preferred embodiments of the present invention, as set forth above, without departing substantially from the principles of the present invention. All such modifications are intended to be included herein within the scope of the present invention, as defined in the following claims.

Wherefore, the following is claimed:

1. A ladder arrangement for stabilizing ladders disposed against structures, the ladder arrangement comprising:

a ladder;

a gutter having a rod-like member extending between an outer upright side member of said gutter to an inner upright side member of said gutter; and a safety apparatus securing said ladder to said gutter, said safety apparatus comprising:

a ladder engagement side member comprising a substantially planar panel having an opening extending from a distal edge of said panel to an internal area of said panel, said opening having a ladder rail of said ladder extending therethrough; and a structure engagement side member connecting to and extending at a transverse angle from said ladder engagement side member, said structure engagement side member being substantially planar, and comprising an aperture extending from a distal edge of said structure engagement side member to an internal area of said structure engagement side member said aperture having said rod-like member extending therethrough.

2.The arrangement of claim 1, wherein said rod-like member is a gutter ferrule.

3. The arrangement of claim 1, wherein said rod-like member is a nail.

4. The arrangement of claim 1, wherein said rod-like member is a screw.

5. The ladder arrangement of claim 1, wherein said opening is T-shaped and comprises a stem part and a cross part, wherein said ladder raft passes through said cross part of said opening.

6. The ladder arrangement of claim 1, wherein said opening comprises a first part and a second part, said first part being substantially rectangular and located internally of said ladder engagement side member distal edge, said second part extending from said first part to said distal edge, and wherein said ladder rail passes through said first part of said opening.

7. The ladder arrangement of claim 1, wherein said aperture is substantially rectangular in shape.

8. The ladder arrangement of claim 1, wherein said distal edges of said ladder engagement side member and said structure engagement side member are non-parallel.

9. The ladder arrangement of claim 1, wherein said opening is L-shaped.

10. The ladder arrangement of claim 1, wherein said opening is defined by a plurality of inner edges, one of said inner edges being configured to prevent said lateral rail from being directly removed from said opening.

* * * * *